US010164368B1

(12) United States Patent
Hsiao

(10) Patent No.: US 10,164,368 B1
(45) Date of Patent: Dec. 25, 2018

(54) ADAPTER AND USING METHOD THEREOF

(71) Applicant: CYBER POWER SYSTEMS, INC., Taipei (TW)

(72) Inventor: Chuan-Han Hsiao, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 0 days.

(21) Appl. No.: 15/787,198

(22) Filed: Oct. 18, 2017

(30) Foreign Application Priority Data

Aug. 8, 2017 (TW) ..... 106126692 A

(51) Int. Cl.
*H01R 13/453* (2006.01)
*H01R 43/26* (2006.01)

(52) U.S. Cl.
CPC ..... *H01R 13/4532* (2013.01); *H01R 43/26* (2013.01)

(58) Field of Classification Search
CPC .... H01R 31/06; H01R 2103/00; H01R 27/00; H01R 35/04; H01R 2107/00; H01R 24/58; H01R 27/02; H01R 31/065; H01R 31/02; H01R 13/44; H01R 13/652; H01R 13/6675; H01R 24/68; H01R 13/447; H01R 24/40
See application file for complete search history.

(56) References Cited

U.S. PATENT DOCUMENTS 6,109,977 A * 8/2000 Baxter ..... H01R 13/04 439/171
2006/0046564 A1* 3/2006 Stanford ..... H01R 24/564 439/578
2010/0190381 A1* 7/2010 Chatterjee ..... H01R 31/065 439/628
2011/0086527 A1* 4/2011 Ruffner ..... H01R 27/00 439/105
2012/0100733 A1* 4/2012 Lee ..... H01R 13/641 439/172
2014/0199867 A1* 7/2014 Rogers ..... H01R 27/00 439/173
2015/0236444 A1* 8/2015 Bdeir ..... H01R 13/6205 361/792

* cited by examiner

*Primary Examiner* — Truc T Nguyen
(74) *Attorney, Agent, or Firm* — Bacon & Thomas, PLLC

(57) ABSTRACT

An adapter including an accommodating element, a driving element having a driving unit, and multiple electrical connectors is provided. The accommodating element has a first space and multiple second spaces. The driving element is sleeved to the accommodating element along an actuating axis. The driving unit has a first electrical connecting portion. In a storage state, the driving unit is stored in the first space, and the electrical connectors are stored in the second space. In an operating state, the first electrical connecting portion of the driving unit is coupled to one of these electrical connecters. Then, the driving unit can enter the second space where the electrical connector stays originally, and at least part of the electrical connector is pushed out of the accommodating element. A using method of the adapter is provided.

20 Claims, 8 Drawing Sheets

ADAPTER AND USING METHOD THEREOF

BACKGROUND OF THE INVENTION

Field of the Invention

The present invention relates to an adapter and using method thereof, and more particularly, the present invention is relates to an adapter and using method thereof, wherein the adapter has a storage function.

Description of Related Art

With the popularity of electronic technology, more and more electrical products are used by people in the daily life and work, such as mobile phones or notebook computers, etc., of which the operation of these electrical products need to rely on power. In addition, these electrical products can couple to the power supply through plug configured in the electrical product for obtaining the required power in operation.

However, different countries have different socket specifications, which are often different from the plug of the electrical product used by the user. Thus, it is important to carry the adapter for people when traveling abroad.

SUMMARY OF THE INVENTION

Accordingly, an object of the present invention is to provide an adapter with functions of carrying conveniently and operating easily by user.

To achieve the foregoing and other objects, an adapter is provided. The adapter includes an accommodating element, a driving element and multiple electrical connectors. The accommodating element has a first space and multiple second spaces. The driving element is sleeved to the accommodating element along an actuated axial, and has a driving unit. Wherein, the driving unit is configured with a first electrical connecting portion. The multiple electrical connectors are stored in the second spaces. In a storage state, the driving unit is stored in the first space, and the electrical connectors are stored in the second spaces. In an operating state, the first electrical connecting portion of the driving unit is coupled to one of the electrical connectors, the driving unit enters the second space where the electrical connector stays originally, and at least part of the electrical connector is pushed out of the accommodating element.

In one embodiment of the present invention, when the storage state is transformed to the operating state, the driving element moves toward the direction away from the accommodating element along the actuated axial for making the driving unit exit out of the first space, the driving element rotates a predetermined angle in the actuated axial for making the first electrical connecting portion of the driving unit couple to the electrical connector, the driving element moves toward the direction of the accommodating element for making the driving unit enter in the second space where the electrical connector stays originally, and at least part of the electrical connector is pushed out of the accommodating element.

In one embodiment of the present invention, one of the accommodating element and the driving element has a pivot, the other of the accommodating element and the driving element has an axial hole, and the pivot is pivoted in the axial hole along the actuated axial.

In one embodiment of the present invention, the driving element further includes a first surrounding surface and a first connecting surface, the first surrounding surface is configured in the outer of the first connecting surface, and the driving unit is configured between the first surrounding surface and the first connecting surface, the first electrical connecting portion of the driving unit is exposed out of the first connecting surface, the accommodating element further includes a second surrounding surface and a second connecting surface, the second surrounding surface is configured in the outer of the second connecting surface, and the first space and the second spaces are formed between the second surrounding surface and the second connecting surface.

In one embodiment of the present invention, a third space is further configured between the first surrounding surface and the first connecting surface, the third space and the second spaces are overlapped in the storage state, the electrical connectors are located in the third space simultaneously, the third space is overlapped with the first space and part of the second spaces in the operating state.

In one embodiment of the present invention, the first connecting surface is configured with a first through hole set, and a external terminal inserts into the first through hole set for coupling with the first electrical connecting portion, multiple second through hole sets are configured on the second connecting surface, each second through hole set is corresponding to one electrical connector, and each electrical connector has a second electrical connecting portion and at least one electrical terminal, the electrical terminal is coupled to the second electrical connecting portion, and the electrical terminal is pushed out of the accommodating element from the corresponding second through hole set.

In one embodiment of the present invention, the second electrical connecting portion is a conductive protrusion, and the first electrical connecting portion has a conductive recess, the conductive protrusion of the second electrical connecting portion is contacted to the conductive recess of the first electrical connecting portion tightly in the operating state.

In one embodiment of the present invention, the first through hole set is a universal plug-hole, and hole position and hole shape of the second through hole sets corresponds to the electrical terminal of each electrical connector.

In one embodiment of the present invention, the driving element further includes a first fastening portion, and each electrical connector further includes a second fastening portion, the first fastening portion is configured at the bottom of the driving unit in the storage state, the second fastening portion is configured on top of each electrical connecter, the first fastening portion and the second fastening portion are fastened with each other in the operating state.

In one embodiment of the present invention, when the driving element moves along the actuating axis to be pushed out of the first space and then rotates about the actuating axis, and the first fastening portion rotates to a limiting space of the second fastening portion.

In addition, another object of the present invention is to provide a using method of an adapter with functions of carrying conveniently and operating easily by user.

A using method of an adapter is further provided. The using method includes the following steps:

providing the foregoing adapter in the storage state; driving the driving element move toward the direction away from the accommodating element along the actuated axial for making the driving unit exit out of the first space; driving the driving element rotate along the actuated axial for coupling to one of the electrical connecters; driving the driving element move toward the direction of the accommodating element; and driving the driving unit enter the second space where the electrical connector stays originally, and at least part of the electrical connector is pushed out of the accommodating element for being an operating state.

BRIEF DESCRIPTION OF THE DRAWINGS

Other features and advantages of the present invention will become apparent in the following detailed description of the preferred embodiments with reference to the accompanying drawings, of which.

DESCRIPTION OF EMBODIMENTS

The characteristics, contents, advantages and achieved effects of the present disclosure will become more fully understood from the detailed description given herein below and the accompanying drawings which are given by way of illustration only, and thus are not limitative of the present disclosure.

As required, detailed embodiments are disclosed herein. It must be understood that the disclosed embodiments are merely exemplary of and may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1A:
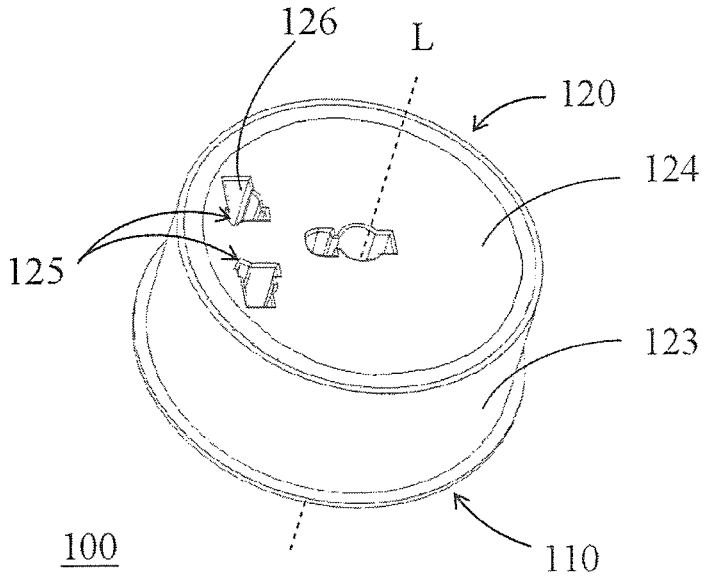
FIG. 1A is a schematic view illustrating an adapter according to one embodiment of the present invention.
Figure 1B:
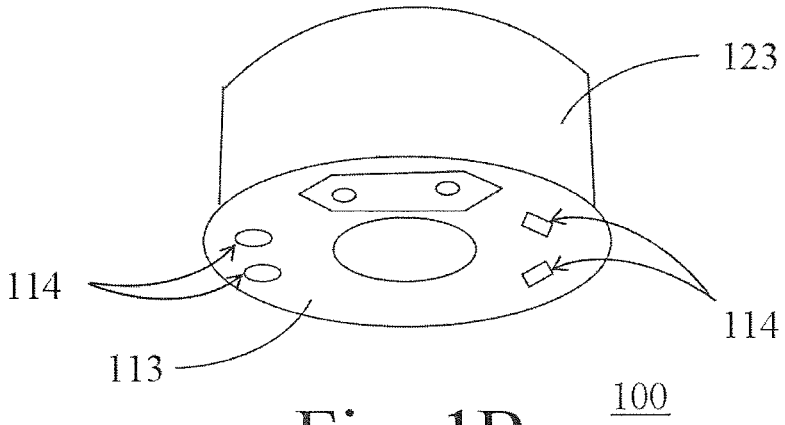
FIG. 1B is a schematic view illustrating the adapter of FIG. 1A in another view.
Figure 2:
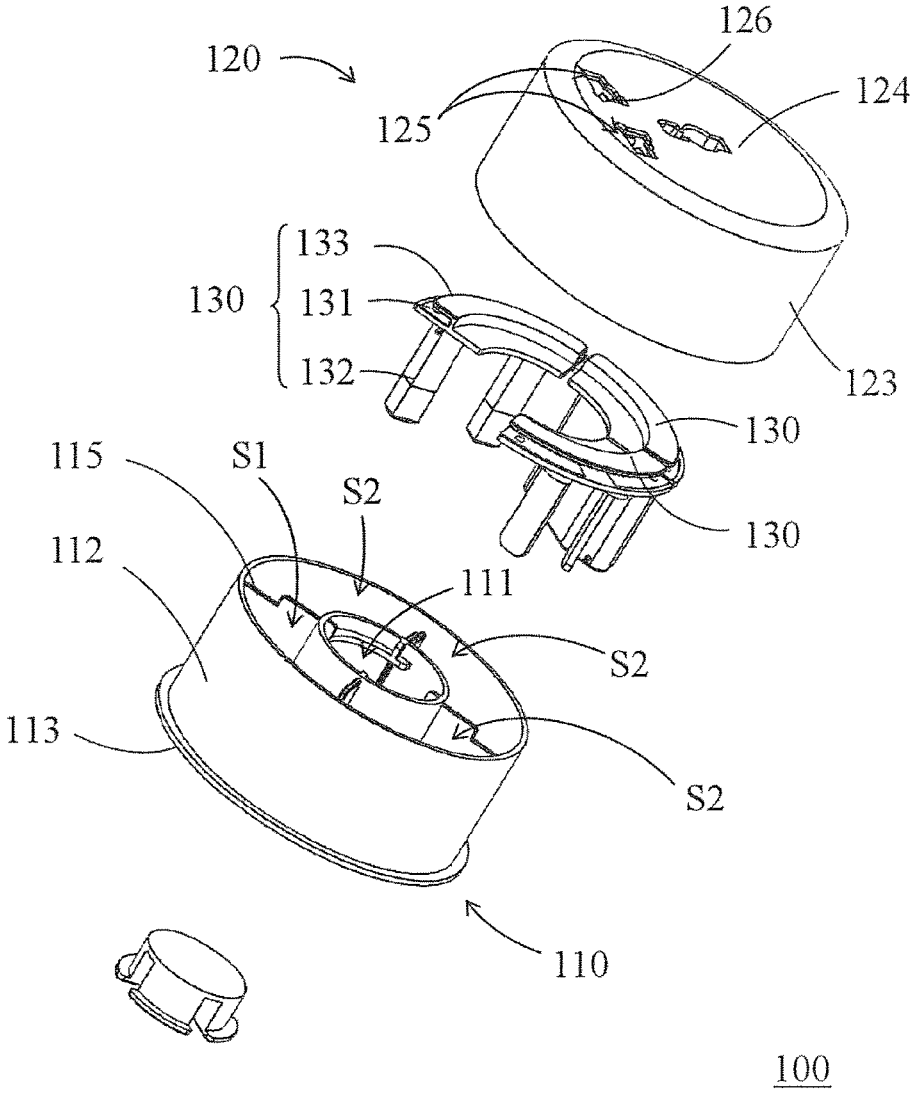
FIG. 2 is an exploded view illustrating the adapter in FIG. 1A.
Figure 3:
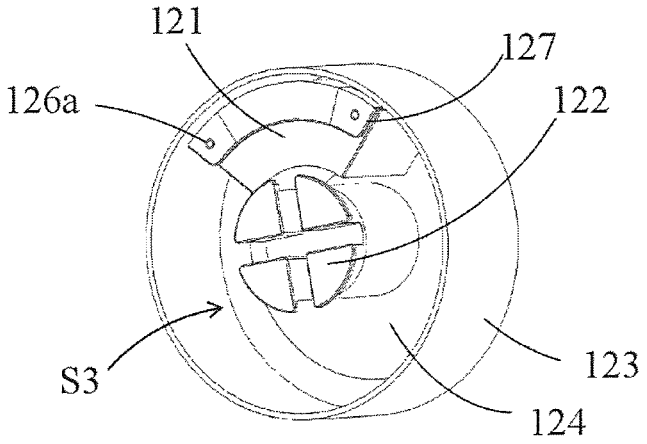
FIG. 3 is a schematic view illustrating the driving element of FIG. 2 in another view.

FIG. 1A is a schematic view illustrating an adapter according to one embodiment of the present invention. FIG. 1B is a schematic view illustrating the adapter of FIG. 1A in another view. FIG. 2 is an exploded view illustrating the adapter in FIG. 1A. FIG. 3 is a schematic view illustrating the driving element of FIG. 2 in another view. Referring to FIG. 1A, FIG. 1B, FIG. 2 and FIG. 3, an adapter 100 of the present embodiment includes an accommodating element 110, a driving element 120 and multiple electrical connectors 130 mainly. Wherein, in the present embodiment, three electrical connectors 130 are exemplified. In other preferred embodiments, the amount of the electrical connectors 130 is not limited. In addition, the electrical 130 are, for example, plugs which are corresponding to various specifications of power sockets.

Figure 4:
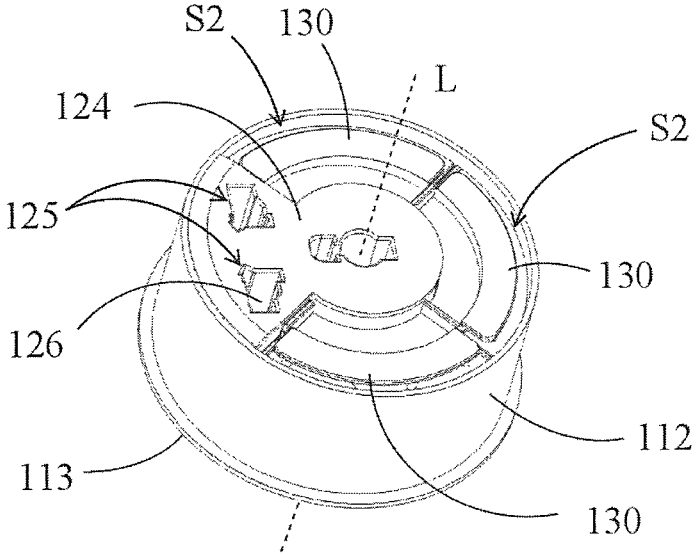
FIG. 4 is a schematic view illustrating the driving element of FIG. 1A which removes the first surrounding surface and part of the first connecting surface.

In the present embodiment, the driving element 120 has a driving unit 121. The driving unit 121 is configured with a first electrical connecting portion 126. In addition, the accommodating element 110 has a first space S1 and multiple second spaces S2. Referring to FIG. 4, wherein FIG. 4 is a schematic view illustrating the driving element of FIG. 1A which removes the first surrounding surface and part of the first connecting surface. In the present embodiment, the first space S1 is suited to store the driving unit 121, and the second spaces S2 are suited to store multiple electrical connectors 130. The amount of the second spaces S2 is, for example, corresponding to the amount of the electrical connectors 130.

Wherein, the driving element 120 includes, for example, a first surrounding surface 123 and a first connecting surface 124. The first surrounding surface 123 is configured in the outer of the first connecting surface 124, and the driving unit 121 is configured between the first surrounding surface 123 and the first connecting surface 124. Wherein, the first electrical connecting portion 126 of the driving unit 121 extends out of the first connecting surface 124. In addition, the accommodating element 110 includes, for example, a second surrounding surface 112 and a second connecting surface 113. The second surrounding surface 112 is configured in the outer of the second connecting surface 113. Wherein, the first space S1 and the second spaces S2 are formed between the second surrounding surface 112 and the second connecting surface 113. In the present embodiment, the accommodating element 110 further includes, for example, a separating structure 115. The space surrounded between the second surrounding surface 112 and the second connecting surface 113 can be defined as the first space S1 and the second spaces S2 by the separating structure 115 suitably.

Especially, the driving element 120 of the present embodiment is sleeved to the accommodating element 110 along an actuating axis L. Thus, the driving element 120 can slides along the actuating axis L opposite to the accommodating element 110. In detail, the accommodating element 110 of the present embodiment is, for example, a base. The driving element 120 is, for example, a cover. The base can be covered by the cover. The cover also can moves along the actuating axis opposite to the base. Further, when the driving unit 121 exits out of the first space S1 and not restrict by the accommodating element 110, the driving element 120 also can rotates in the actuating axis L. Thus, the present embodiment can make the adapter 100 transform from a storage state with function of carrying conveniently to an operating state with function of coupling to power supply by driving the driving unit 121 easily. Certainly, the adapter 100 of the present embodiment also has thin volume for operating by users.

Figure 5A:
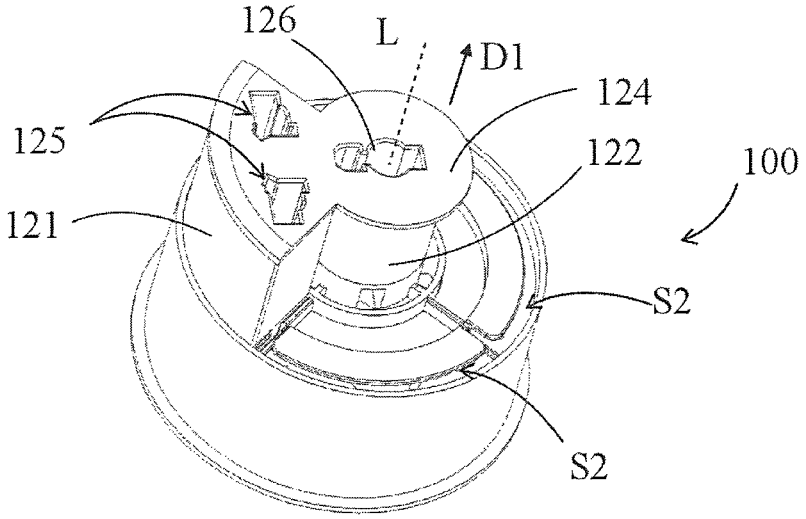
FIGS. 5A-5C are schematic views illustrating the adapter of FIG. 4 which transforms form a storage state to a operating state.
Figure 5B:
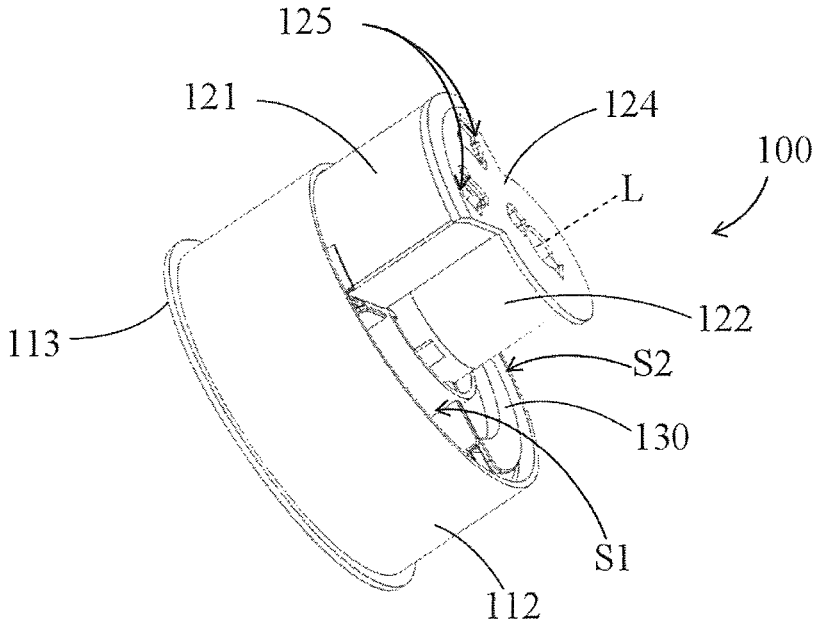
Figure 5C:
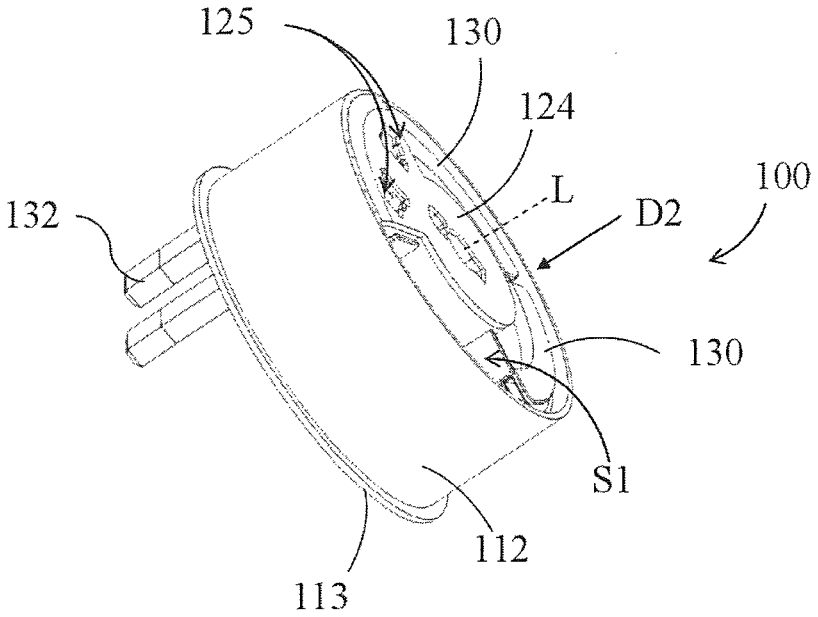
Figure 6A:
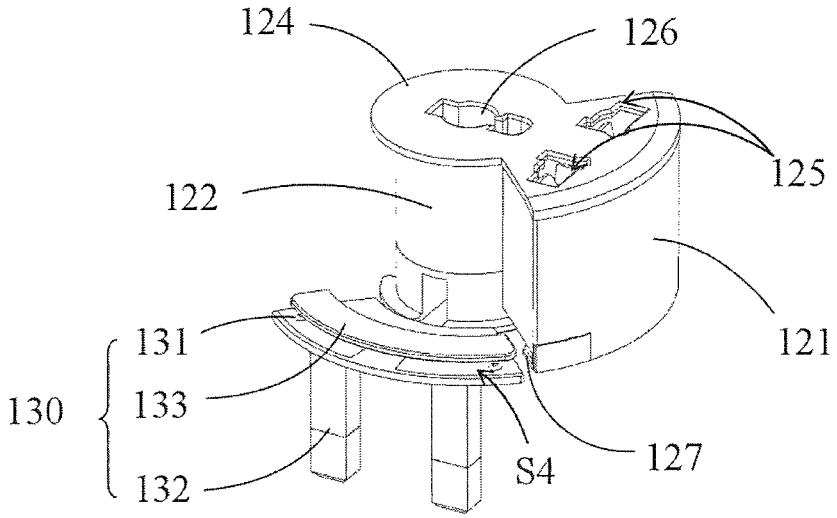
FIGS. 6A-6C are operational views illustrating the adapter of FIGS. 5A-5B which removes accommodating element.
Figure 6B:
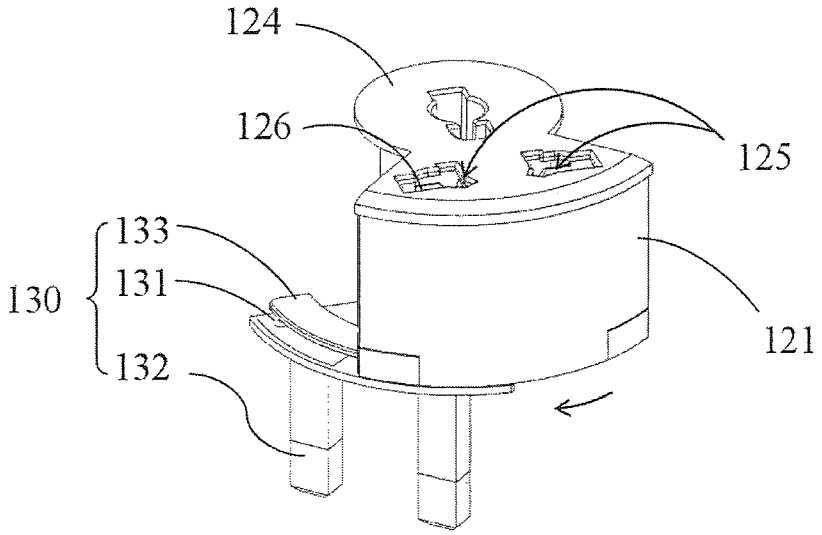
Figure 6C:
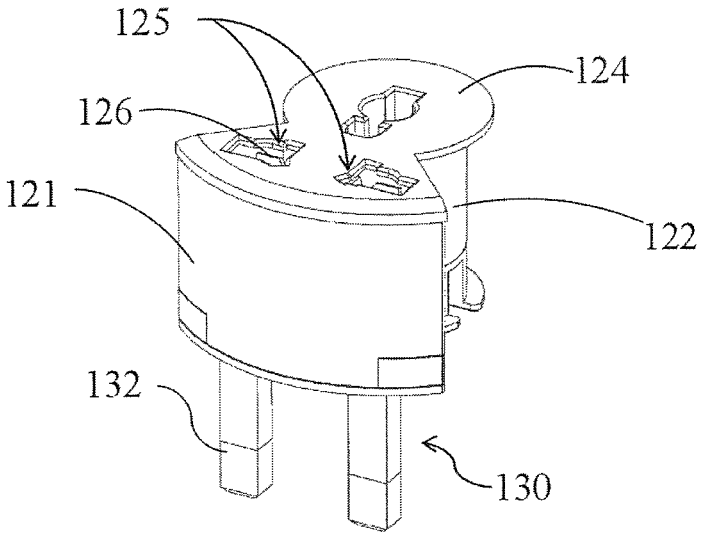

In detail, when the adapter 100 is in the storage state (as shown in FIG. 1 and FIG. 4), the accommodating element 110 and the driving element 120 are sleeved with each other. The driving unit 121 is stored in the first space S1, and multiple electrical connectors 130 are stored in the corresponding second spaces S2. Referring to FIGS. 5A-5C and FIGS. 6A-6C, wherein FIGS. 5A-5C are schematic views illustrating the adapter of FIG. 4 which transforms form a storage state to a operating state, and FIGS. 6A-6C are operational views illustrating the adapter of FIGS. 5A-5B which removes accommodating element. When the adapter 100 transforms from the storage state (as shown in FIG. 1 and FIG. 4) to the operating state (as shown in FIG. 5C), the driving element 120 can moves toward the direction D1 away from the accommodating element 110 along the actuating axis L (as shown in FIG. 5A and FIG. 6A) so that the driving unit 121 can be exited out of the first space S1.

From above, when the driving unit 121 is exited out of the first space S1, the driving element 120 can rotates in the actuating axis L (as shown in FIG. 6A and FIG. 6B) so that the first electrical connecting portion 126 of the driving unit 121 can couple to one of the electrical connectors 130 (as shown in FIG. 5B and FIG. 6C). Wherein, when the driving element 120 rotates a predetermined angle in the actuating axis L, the driving element 120 can couple to one electrical connector 130 effectively. Next, the driving element 120 can moves toward the direction D2 of the accommodating element 110 for making the driving unit 121 enter the second space S2 where the electrical connector 130 stays originally. Further, at least part of the electrical connector 130 can be pushed out of the accommodating element 110 (as shown in FIG. 5C). In other words, the adapter 100 presented in FIG. 5C is in the operating state and can be coupled to external power socket (not shown).

In addition, in the present embodiment, the first connecting surface 124 is, for example, configured with a first through hole set 125, and a external terminal (not shown) inserts into the first through hole set 125 for coupling with the first electrical connecting portion 126. Wherein, the first through hole set 125 is, for example, a universal plug-hole. The external terminal is, for example, a plug terminal of electrical device. On the other hand, multiple second through hole sets 114 (as shown in FIG. 1B) are, for example, configured in the second connecting surface 113. Each second through hole set 114 is corresponding to one electrical connector 130. Besides, the electrical connector 130 has, for example, a second electrical connecting portion 131 and at least one electrical terminal 132. The electrical terminal 132 is coupled to the second electrical connecting portion 131. In detail, the hole position and hole shape of the second through hole set 114 is, for example, corresponding to the electrical terminal 132 of each electrical connector 130. Therefore, when the driving unit 121 of the driving element 120 enters into the second space S2 where one electrical connector 130 stays originally, the electrical terminal 132 of the electrical connector 130 can be pushed out of the accommodating element 110 from the corresponding second through hole set 114. Further, the electrical terminal 132 can insert into external prong-hole. The external prong-hole is, for example, configured in a power socket (not shown).

Figure 7:
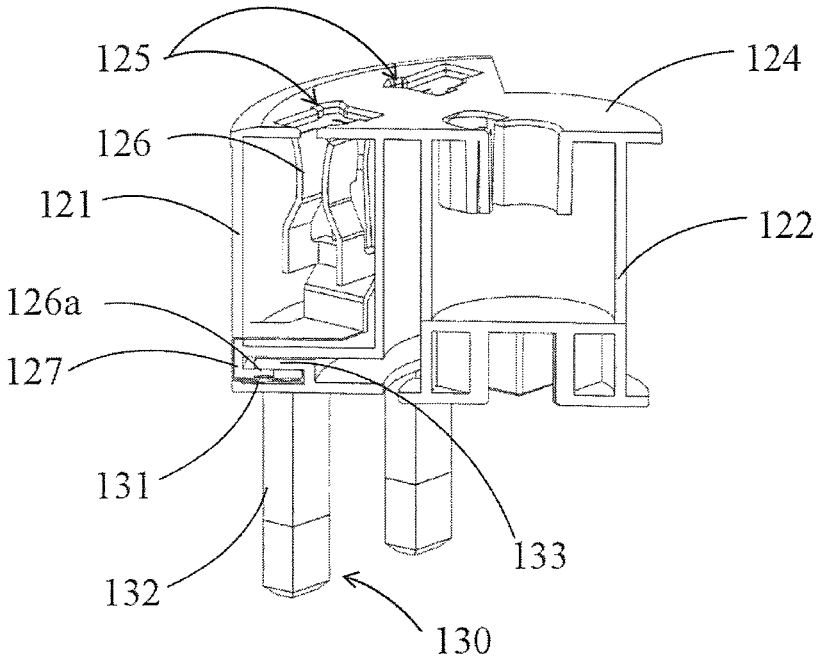
FIG. 7 is a partial cross sectional illustrating the adapter according to one embodiment of the present invention.
Figure 8:
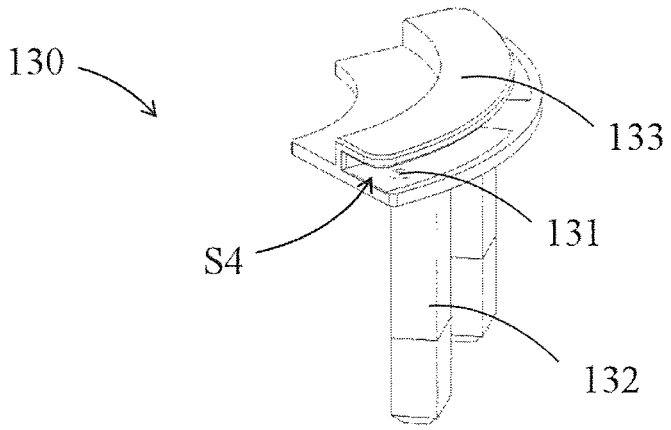
FIG. 8 is a schematic view illustrating the electrical connector according to one embodiment of the present invention.

FIG. 7 is a partial cross sectional illustrating the adapter according to one embodiment of the present invention. FIG. 8 is a schematic view illustrating the electrical connector according to one embodiment of the present invention. Referring to FIG. 7 and FIG. 8, the driving element 120 further includes a first fastening portion 127, and each electrical connector 130 can includes a second fastening portion 133. Wherein, in the storage state, the first fastening portion 127 is configured in bottom of the driving unit 121. On the other hand, the second fasten portion 133 is configured in top of each electrical connector 130. In the operating state, when the driving element 120 moves along the actuating axis L to exit out of the first space S1, the driving element 120 can rotates in the actuating axis L. Thus, the first fastening portion 127 can rotates to a limiting space S4 of the second fastening portion 133. In other words, the first fastening portion 127 and the second fasten portion 133 can be fastened with each other by the rotation of the driving element 120. Further, the electrical terminal 132 of the electrical connector 130 can be pushed out of the accommodating element 110 stably by the driving element 120. Wherein, the first fastening portion 127 and the second fastening portion 133 are, for example, made of non-conductive material.

In addition, in a preferred embodiment, the second electrical connecting portion 131 is a conductive protrusion, and the first electrical connecting portion 126 has a conductive recess 126*a*. In the operating state of the adapter 100, the conductive protrusion of the second electrical connecting portion 131 is contacted to the conductive recess 126*a* of the first electrical connecting portion 126 tightly when the driving element 120 is connected to the electrical connector 130. Therefore, the first electrical connecting portion 126 of the driving unit 121 can couple to the electrical connector 130 effectively and stably.

Besides, a restricted protrusion (not shown) can be configured on inner wall of the second surrounding surface 112 of the accommodating element 110 in the present embodiment. Thus, in the storage state of the adapter 100, the electrical connector 130 can be restricted in the corresponding second space S2 by the interference between the second fastening portion 133 and the restricted protrusion. In the operating state of the adapter 100, the electrical connector 130 can release the interference of the restricted protrusion by the push of the driving unit 121. Further, the electrical connector 130 can be pushed out of the accommodating element 110. Certainly, when the electrical connector 130 is pushed out of the accommodating element 110, the electrical connector 130 also can be pulled back to the original second space S2 by the driving unit 121 through the fastening relationship between the first fastening portion 127 and the second fastening portion 133. And then, the electrical connector 130 can be restricted in the corresponding second space S2 again through the interference between the second fastening portion 133 and the restricted protrusion.

Further, in the present embodiment, a axial hole 111 is configured in the accommodating element 110, and a pivot 122 is configured in the driving element 120. The pivot 122 is pivoted in the axial hole 111 along the actuating axis L. Thus, the driving element 120 can be sleeved to the accommodating element 110 along actuating axis L effectively, and rotates in the actuating axis L. In other preferred embodiments, the pivot also can be configured in the accommodating element 110, the axial hole can be configured in the driving element 120, and it is not limited in the invention.

On the other hand, in the present embodiment, a third space S3 can be configured between the first surrounding surface 123 and the first connecting surface 124. Thus, in the storage state of the adapter 100, the third space S3 can be overlapped with the second spaces S2. In other words, in the storage state of the adapter 100, the electrical connectors 130 can locates in the third space S3 simultaneously. In the operating state of the adapter 100, because the driving unit 121 exits out of the first space S1 and enters in one second space S2, so that the third space S3 is overlapped with the first space S1 and part of the second spaces S2.

Figure 9:
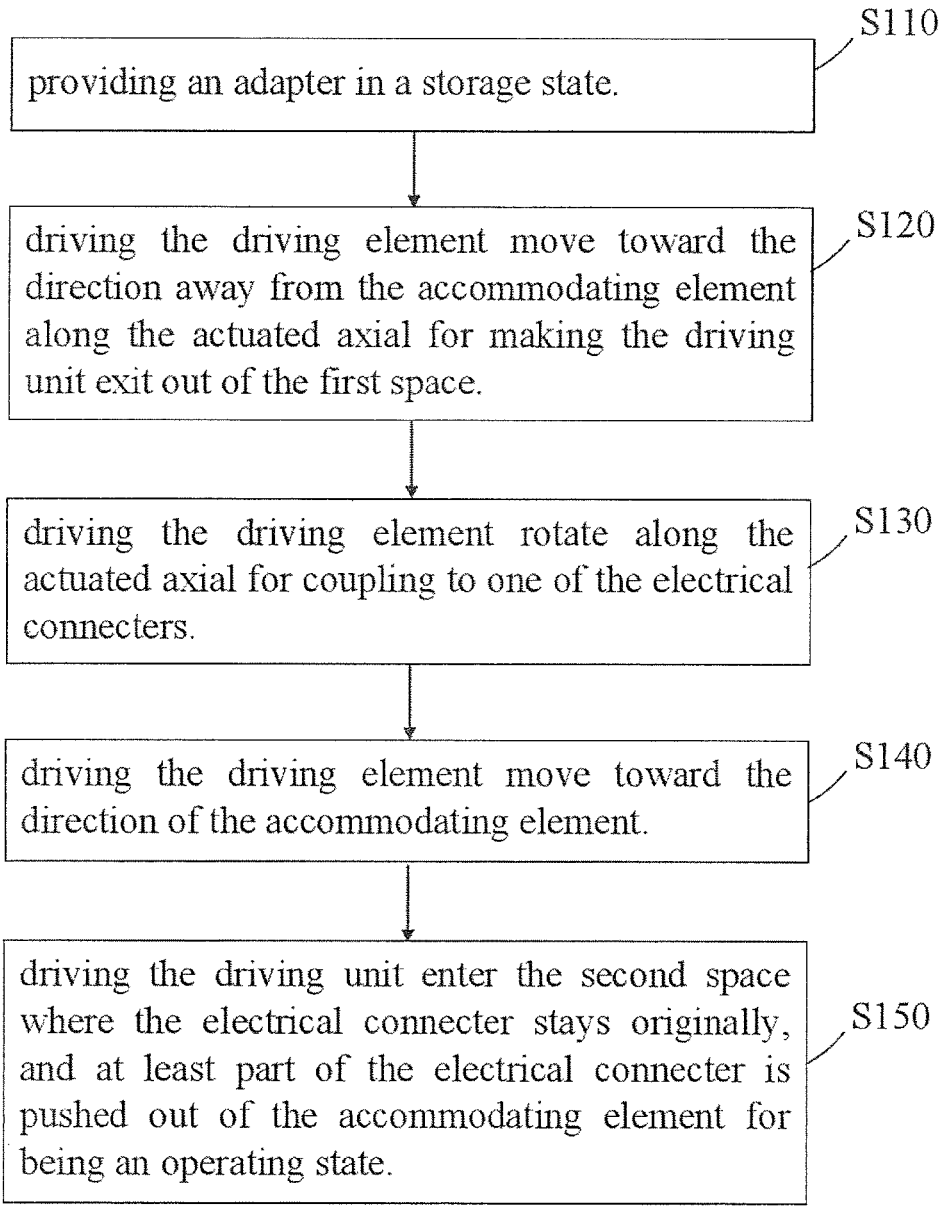
FIG. 9 is a flow chart illustrating the using method of the adapter according to one embodiment of the present invention.

FIG. 9 is a flow chart illustrating the using method of the adapter according to one embodiment of the present invention. Referring to FIG. 9, the using method of the adapter in the present embodiment includes the following steps: firstly, in Step S110, providing an adapter in a storage state. Wherein, as described above, the adapter includes the accommodating element, the driving element and multiple electrical connectors. In addition, the accommodating element has the first space and multiple second spaces S. The driving element is sleeved to the accommodating element along the actuating axis, and has a driving unit. The driving unit is configured with the first electrical connecting portion. Wherein, the driving unit is stored in the first space, and the electrical connectors are stored in the second spaces.

After step S110, step S120 is executed, driving the driving element move toward the direction away from the accommodating element along the actuating axis for making the driving unit exit out of the first space. Then, step S130 is executed, driving the driving element rotate along the actuating axis for coupling to one of the electrical connectors. Next, step S140 is executed, driving the driving element move toward the direction of the accommodating element. Thereafter, step S150 is executed, driving the driving unit enter the second space where the electrical connector stays originally, and at least part of the electrical connector is pushed out of the accommodating element for being an operating state.

To sum up, in the storage state of the adapter, the driving unit and the electrical connector are both configured in the accommodating element, and the driving element and the accommodating element are sleeved to each other completely (as shown in FIG. 1A). Thus, the adapter of the present invention has a preferred function of storage for carrying easily by users. Besides, the adapter of the present invention can be transformed from the storage state to the operating state through easy sliding and rotating steps. In other words, the adapter of the present invention has the function of operating easily.

In addition, when the adapter of the present invention transforms to be in the operating state, the required electrical connector terminal is pushed out of the accommodating element by the driving unit for coupling with the external power socket. Wherein, the plug terminal of external electrical device can be inserted into the first through hole set for coupling to terminal of the required electrical connector. Thus, the external electrical device can be powered by the electrical connection between the electrical connector and external power socket.

Worth mention, when the adapter of the present invention transforms to be in the operating state, only the required electrical connector terminal is pushed out of the accommodating element, the driving unit and other electrical connectors are also stored in the accommodating element. In other words, even when the adapter of the present invention is in the operating state, the adapter of the present invention still can be with preferred storage function, and also has thin volume for operating by users.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An adapter, comprising:

an accommodating element, having a first space and multiple second spaces;

a driving element, sleeved to the accommodating element along an actuating axis, and a driving unit driven by the driving element including a first electrical connecting portion; and multiple electrical connectors, stored in the second spaces;

wherein, in a storage state, the driving unit is stored in the first space, and the electrical connectors are stored in the second spaces; and wherein, in an operating state, the driving unit is moved from the first space to one of the second spaces containing a selected one of the electrical connectors and the first electrical connecting portion of the driving unit is coupled to a selected one of the electrical connectors, and wherein, as the driving unit enters the second space containing the selected electrical connector, the driving unit pushes at least part of the selected electrical connector out of the accommodating element.

2. The adapter according to claim 1, wherein when the storage state is transformed to the operating state, the driving element first moves in a first direction along the actuating axis to cause the driving unit to exit out of the first space, the driving element then rotates a predetermined angle about the actuating axis to cause the first electrical connecting portion of the driving unit to couple to the electrical connecter, and the driving element then moves in a second direction opposite the first direction to cause the driving unit to enter the second space where the selected electrical connecter is stored, and at least part of the electrical connecter is pushed out of the accommodating element.

3. The adapter according to claim 1, wherein one of the accommodating element and the driving element has a pivot, the other of the accommodating element and the driving element has an axial hole, and the pivot is pivoted in the axial hole along the actuating axis.

4. The adapter according to claim 1, wherein the driving element further includes a first surrounding surface and a first connecting surface, the first surrounding surface is outside the first connecting surface, the driving unit is stored between the first surrounding surface and the first connecting surface, the first electrical connecting portion of the driving unit extends out of the first connecting surface, the accommodating element further includes a second surrounding surface and a second connecting surface, the second surrounding surface is outside the second connecting surface, and the first space and the second spaces are formed between the second surrounding surface and the second connecting surface.

5. The adapter according to claim 4, wherein a third space is further configured between the first surrounding surface and the first connecting surface, the third space and the second spaces overlap in the storage state, the electrical connectors are located in the third space simultaneously, and the third space overlaps the first space and part of the second spaces in the operating state.

6. The adapter according to claim 4, wherein the first connecting surface is configured with a first through hole set, and an external terminal is inserted into the first through hole set for coupling with the first electrical connecting portion, multiple second through hole sets are configured on the second connecting surface, each second through hole set corresponds to one electrical connecter, and each electrical connecter has a second electrical connecting portion and at least one electrical terminal, the electrical terminal is coupled to the second electrical connecting portion, and the electrical terminal is pushed out of the accommodating element from the corresponding second through hole set.

7. The adapter according to claim 6, wherein the second electrical connecting portion is a conductive protrusion, the first electrical connecting portion has a conductive recess, and the conductive protrusion of the second electrical connecting portion is tightly contacts the conductive recess of the first electrical connecting portion in the operating state.

8. The adapter according to claim 6, wherein the first through hole set is a universal plug-hole, and the plug-hole position and plug-hole shape of the second through hole set corresponds to the electrical terminal of each electrical connecter.

9. The adapter according to claim 1, wherein the driving element further includes a first fastening portion, and each electrical connecter further includes a second fastening portion, the first fastening portion is configured at a bottom of the driving unit in the storage state, the second fastening portion is configured on top of each electrical connecter, and the first fastening portion and the second fastening portion are fastened with each other in the operating state.

10. The adapter according to claim 9, wherein when the driving element moves along the actuating axis to exit out of the first space and then rotates about the actuating axis, and the first fastening portion rotates to a limiting space of the second fastening portion.

11. A using method of an adapter, comprising:

providing an adapter in a storage state, the adapter including an accommodating element, a driving element and multiple electrical connectors, the accommodating element having a first space and multiple second spaces, and the driving element being sleeved to the accommodating element along an actuating axis, the driving element driving a driving unit, wherein the driving unit is configured with a first electrical connecting portion, the driving unit is stored in the first space, and the electrical connectors are stored in the second spaces;

driving the driving element to move along the along the actuating axis in a first direction to cause the driving unit to exit out of the first space;

driving the driving element to rotate about the actuating axis so that the first electrical connecting portion couples to a selected one of the electrical connecters;

driving the driving element move along the actuating axis is a second direction opposite the first direction to cause the driving unit to enter the respective one of the second spaces in which the selected electrical connector is stored, and push at least part of the selected electrical connecter out of the accommodating element to enable an operating state.

12. The using method according to claim 11, wherein the driving element rotates a predetermined angle about the actuating axis for making the first electrical connecting portion of the driving unit couple to the electrical connecter.

13. The adapter according to claim 11, wherein one of the accommodating element and the driving element has a pivot, the other of the accommodating element and the driving element has an axial hole, and the pivot is pivoted in the axial hole along the actuating axis.

14. The adapter according to claim 11, wherein the driving element further includes a first surrounding surface and a first connecting surface, the first surrounding surface is outside the first connecting surface, the driving unit is stored between the first surrounding surface and the first connecting surface, the first electrical connecting portion of the driving unit extends out of the first connecting surface, the accommodating element further includes a second surrounding surface and a second connecting surface, the second surrounding surface is outside the second connecting surface, and the first space and the second spaces are formed between the second surrounding surface and the second connecting surface.

15. The adapter according to claim 14, wherein a third space is further configured between the first surrounding surface and the first connecting surface, the third space and the second spaces overlap in the storage state, the electrical connectors are located in the third space simultaneously, and the third space overlaps the first space and part of the second spaces in the operating state.

16. The adapter according to claim 14, wherein the first connecting surface is configured with a first through hole set, and an external terminal is inserted into the first through hole set for coupling with the first electrical connecting portion, multiple second through hole sets are configured on the second connecting surface, each second through hole set corresponds to one electrical connecter, and each electrical connecter has a second electrical connecting portion and at least one electrical terminal, the electrical terminal is coupled to the second electrical connecting portion, and the electrical terminal is pushed out of the accommodating element from the corresponding second through hole set.

17. The adapter according to claim 16, wherein the second electrical connecting portion is a conductive protrusion, the first electrical connecting portion has a conductive recess, and the conductive protrusion of the second electrical connecting portion is tightly contacts the conductive recess of the first electrical connecting portion in the operating state.

18. The adapter according to claim 16, wherein the first through hole set is a universal plug-hole, and the plug-hole position and plug-hole shape of the second through hole set corresponds to the electrical terminal of each electrical connecter.

19. The adapter according to claim 11, wherein the driving element further includes a first fastening portion, and each electrical connecter further includes a second fastening portion, the first fastening portion is configured at a bottom of the driving unit in the storage state, the second fastening portion is configured on top of each electrical connecter, and the first fastening portion and the second fastening portion are fastened with each other in the operating state.

20. The adapter according to claim 19, wherein when the driving element moves along the actuating axis to exit out of the first space and then rotates about the actuating axis, and the first fastening portion rotates to a limiting space of the second fastening portion.

* * * * *